US006688514B2

(12) United States Patent
Evans et al.

(10) Patent No.: US 6,688,514 B2
(45) Date of Patent: Feb. 10, 2004

(54) BULK BOX WITH A QUICK LOCK BOTTOM AND SMOOTH INTERIOR BOTTOM SURFACE

(75) Inventors: John Evans, Hermine, PA (US); William F. Moss, Canonsburg, PA (US); Steve Mynes, Lakewood, NY (US); Stephen R. Byrski, Bethel Park, PA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 10/017,359

(22) Filed: Dec. 14, 2001

(65) Prior Publication Data

US 2002/0158114 A1 Oct. 31, 2002

Related U.S. Application Data

(60) Provisional application No. 60/255,698, filed on Dec. 15, 2000.

(51) Int. Cl.[7] ..... B65D 5/00
(52) U.S. Cl. ..... 229/109
(58) Field of Search ..... 229/128, 109, 229/155, 185, 156, 157, 158, 148

(56) References Cited

U.S. PATENT DOCUMENTS 2,779,527 A * 1/1957 Fallert ..... 229/157
3,244,355 A * 4/1966 Nolen ..... 229/157
3,297,230 A * 1/1967 Stegner ..... 229/156 X
4,386,729 A * 6/1983 Schmidt ..... 229/109 X
4,817,796 A * 4/1989 Camillo et al. ..... 229/157 X
5,485,951 A * 1/1996 Phillips ..... 229/156
6,364,200 B1 * 4/2002 Moss et al. ..... 229/109

* cited by examiner

*Primary Examiner*—Tri Mai
(74) *Attorney, Agent, or Firm*—Dennis H. Lambert

(57) ABSTRACT

A corrugated paperboard bulk box has opposed pairs of parallel side walls, and in a preferred embodiment, has interposed diagonal corner panels to form an octagonal box. The bottom of the box is closed by first and second opposed pairs of flaps, wherein a T-shaped locking tab is formed on the free edge of one of the flaps of the first pair, and a notch is formed in the free edge of each of the flaps of the second pair. In erecting the box, the flaps of the first pair are first folded inwardly over the bottom of the box, with the free edges thereof confronting one another and the flaps lying in substantially flush, coplanar relationship. The flaps of the second pair are then folded inwardly over the first pair, with the free edges of the flaps of the second pair lying in confronting relationship with one another and the notches therein defining a central opening. The locking tab is pulled outwardly through the central opening to lock the flaps in their inwardly folded relationship and define a smooth interior bottom surface in the box.

8 Claims, 6 Drawing Sheets

BULK BOX WITH A QUICK LOCK BOTTOM AND SMOOTH INTERIOR BOTTOM SURFACE

This application claims the benefit of prior U.S. provisional patent application Serial No. 60/255,698, filed Dec. 15, 2000, and entitled "Bulk Box With A Quick Lock Bottom and Smooth Interior Bottom Surface".

BACKGROUND OF THE INVENTION

1. Field of the Invention

This invention relates to containers for the bulk storage and shipment of materials. More particularly, the invention relates to a corrugated paperboard bulk box with set-up assisting features, a locking bottom flap construction, and a smooth interior surface.

2. Prior Art

In the bulk handling of materials, e.g., bulk resins, fruit juices, tomato paste, meat, fresh produce, etc., containers of relatively large size are commonly used to transport and store the material. These containers must be capable of withstanding the weight of the contents, as well as the rough handling to which they may be subjected. Further, they should be relatively easy to set up, and capable of being stacked on top of one another, and of being handled with mechanized equipment. In addition, it is sometimes desirable or necessary to place a flexible bag liner inside the box, especially for the handling of fluid materials.

A variety of containers have been developed in the prior art to meet these criteria, including metal drums, plywood bins and corrugated paperboard boxes. While metal drums and plywood bins possess the requisite strength and durability, they are expensive to manufacture, store and ship. Corrugated paperboard boxes are less costly to make, and generally can be collapsed for compact storage and shipment. However, they may be difficult to set up, and/or may not be capable of withstanding rough handling, and/or may have elements protruding into the interior of the box, exposing the liner to potential damage from such protrusions.

Accordingly, there is a need for a bulk container which is inexpensive to make and use, is strong and durable, may be collapsed for compact storage and shipment, is easy to set up, and which has a smooth interior surface.

SUMMARY OF THE INVENTION

The present invention comprises a bulk container which is strong and durable, which may be collapsed for compact storage and shipment, which may be set up quickly and easily, and which has a smooth interior surface.

The container of the invention preferably is made of corrugated paperboard having adequate strength to withstand the weight of the contents and to enable multiple containers to be stacked on top of one another. It is also capable of being palletized so that it can be efficiently handled with mechanized equipment. The container can be collapsed for compact storage, and has a simplified locking bottom flap construction that is quick and easy to set up and is durable even when subjected to rough handling. The container of the invention also has aligning means which facilitates positioning and squaring up of the container during set up, and which holds it in that position after it is set up.

In a preferred embodiment, the container of the invention is an octagonal corrugated paperboard box having opposed pairs of parallel side walls and diagonal corner panels.

Opposed pairs of major and minor bottom flaps are foldably joined along score lines at one edge to respective pairs of opposed side walls, and have opposite free edges.

The locking bottom flap construction includes a notch or cut-out in the free edge of each of the minor flaps, and a T-shaped central locking tab in the free edge of one of the major flaps. When the flaps are folded inwardly toward one another to close the bottom of the box, the free edges of the major flaps meet in flush, abutting relationship, with an end portion of the locking tab lying against the adjacent edge of the opposed bottom flap. The minor flaps overlie the major flaps and the locking tab, with the notches in the free edges of the minor flaps in registry with the locking tab.

The T-shaped locking tab has bendable arms protruding from opposite sides of its free end, whereby the free end of the tab may be grasped and pulled through the opening formed by the notches in the confronting edges of the minor flaps, whereby the arms engage against the confronting edges of the minor flaps to hold or lock the flaps in their inwardly folded position.

This structure presents a smooth interior bottom surface, with no protrusions extending into the box that might pose a risk of chafing or puncturing of a flexible bag liner placed in the box.

Further, the major flaps include side portions extending in alignment with and cut from the bottom ends of the associated diagonal corner panels, so that when the major flaps are folded inwardly over the bottom of the box, the corners of the side portions project beyond the diagonal corner panels to define fastening tabs that may be used to secure the box to a pallet.

The aligning means includes a pair of spaced apart slots at the score line joining each minor bottom flap to its associated side wall, and a small tab projecting outwardly from the side edge of each of the side portions of the major bottom flaps. The tabs project into the slots to position and square-up the box and hold it in this position as the box is being set up and after the box is set up. More specifically, during set up of the box the minor flaps, or at least one of them, are in generally coplanar relationship with its associated side wall, and the major flaps, or at least one of them, are then folded inwardly over the bottom of the box, sweeping the tab along the surface of an adjacent minor flap until the tab comes into registry with the slot, whereupon the tab projects into the slot to hold the major flap in this folded position. After both major flaps are thus folded, the minor flaps are folded inwardly over the major flaps, and the locking tab engaged. The location of the tabs and slots is such that when they are interengaged the box is properly aligned and squared.

When the major flaps and then the minor flaps are folded inwardly over the bottom of the box into overlying relationship with one another, it is necessary only to pull the T-shaped locking tab outwardly to cause the tab to flex and move through the opening formed by the notches in the confronting edges of the minor bottom flaps, whereupon the arms or wings of the "T" expand or spring outwardly to engage behind the bottom flaps to lock the tab, and thus the bottom flaps, in closed position. The bottom flaps are thereby securely interlocked with one another to form a strong closed bottom that remains in its erected condition even when the box is roughly handled.

The corners of the arms are rounded to eliminate the potential for the T-shaped tab to get caught or snagged on any other edge and be tom. The arms are partially defined by diagonal scores which cause the arms to bend in the appropriate location and eliminate tearing. Further, by facilitating bending of the arms in the appropriate manner, the durability of the locking tab is increased, enabling it to last through many cycles of use.

Means may also be provided in the sidewalls for locking cooperation with a closure cap or cover to be fitted over the top end of the box. In one embodiment, this means comprises openings formed through at least a pair of opposed side walls near the top end thereof for cooperation with the tabs on the cover.

Although the preferred embodiment is an octagonal or eight-sided box, it should be understood that the invention may be adapted to other polygonal shapes, such as a four-sided or ten-sided box, for example. Further, the box of the invention may comprise any suitable flute construction, including AA, CA, BC, etc., depending upon the desired properties. Moreover, a moisture resistant adhesive may be used in the manufacture of the box, which may additionally be treated with a suitable commercially available moisture resistant material. Further, if desired, a liner may be placed inside the box. The liner and the box may each comprise one-piece triple wall constructions laminated together.

The bottom flap construction with flush, abutting flap edges and a locking tab structure that does not extend or protrude into the interior of the box, may be used with or without the aligning feature. Further, in applications which do not require the outside (major) flaps to be held in the closed position, the die-cut bottom style of the invention can be used without the T-shaped locking tab.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
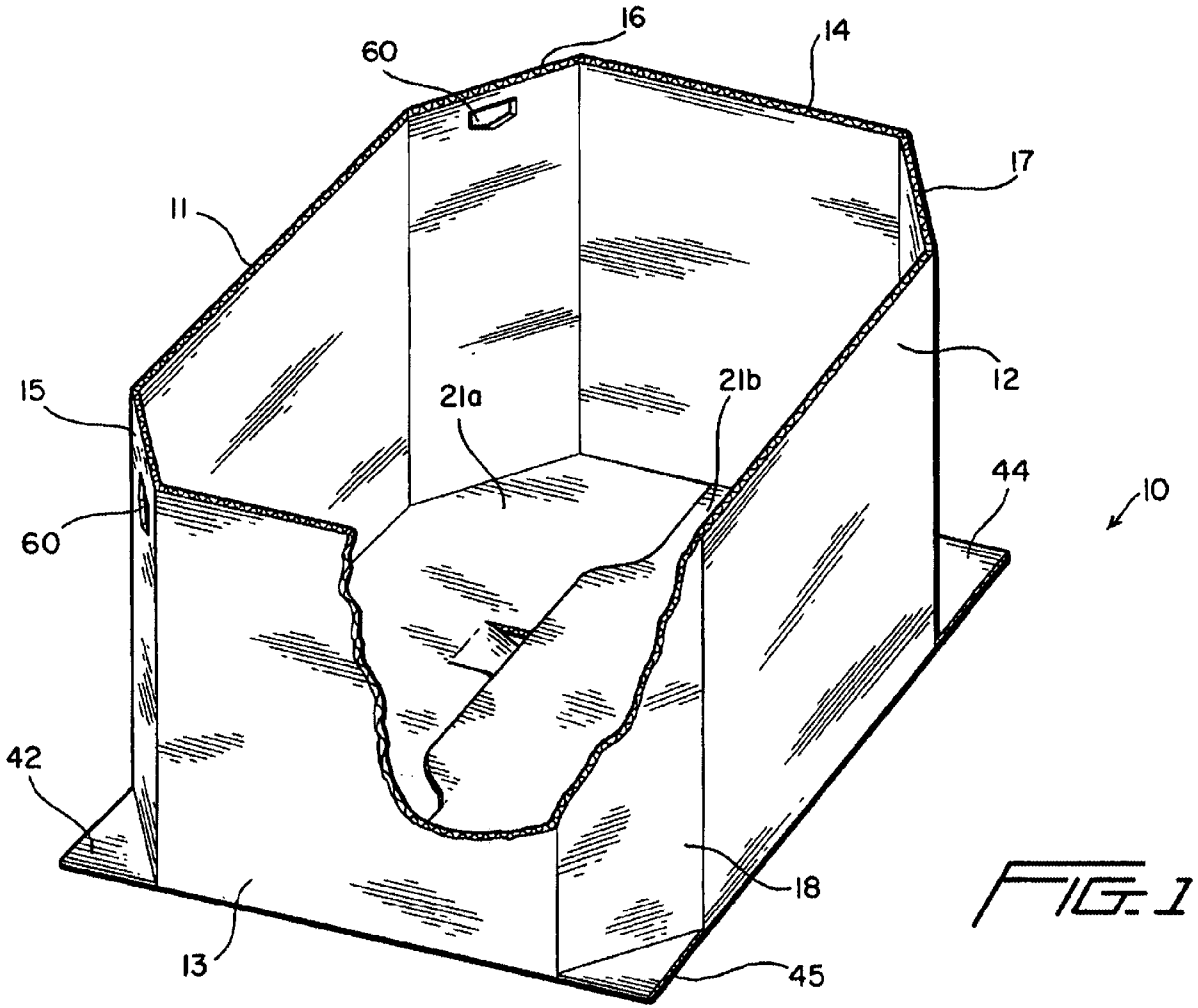
FIG. 1 is a top perspective view of an erected box according to the invention, shown without a cover or cap, and with a portion of the side wall cut away to show the smooth interior bottom surface.

Referring more specifically to the drawings, an octagonal corrugated bulk box according to the invention is indicated generally at 10. The box includes pairs of opposed parallel side walls 11, 12 and 13, 14, and diagonal corner panels 15, 16, 17 and 18. Although not shown, a lid or cover may be placed on the open upper end of the container, and the box may be mounted on a pallet.

The bottom of the box is closed by opposed pairs of major bottom flaps 21*a*, 21*b* and minor bottom flaps 22*a*, 22*b*, respectively foldably joined along fold lines 23*a*, 23*b* and 24*a*, 24*b* at one edge to the bottom edges of the opposed pairs of side walls. The major and minor bottom flaps have opposite free edges 25*a*, 25*b* and 26*a*, 26*b*, respectively, with notches 27*a*, 27*b* in the free edges of the respective minor flaps, and a projection 29*a* on the free edge of one of the major flaps and a complementally shaped recess 29*b* in the free edge of the other major flap.

A generally T-shaped locking tab 30 is formed on the free edge 25*a* of major flap 21*a*, extending into the recess 29*b*. The locking tab is foldably joined along score line 31 at one end to the bottom flap 21*a*, and has oppositely outwardly directed arms 32 and 33 joined to its free end along diagonal scores 34 and 35. As seen best in FIG. 5, the inner and outer corners 36 and 37 of the locking tab are rounded to minimize unwanted catching or snagging of the tab during handling of the box.

Figure 5:
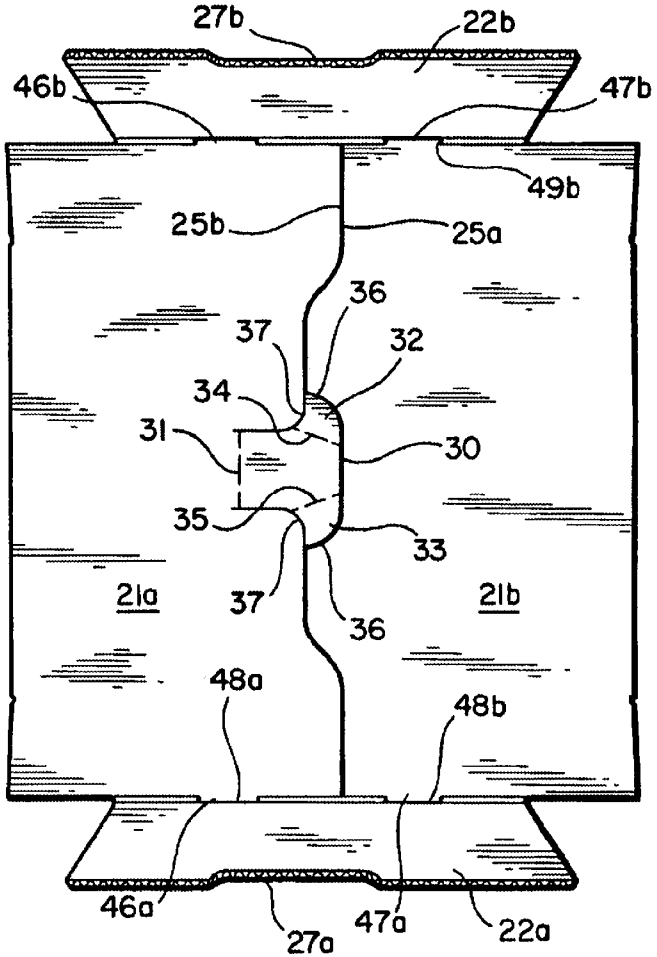
FIG. 5 is an outside bottom view of the box, shown with the major flaps folded inwardly to bring their respective alignment tabs into registry with associated slots at the score of the adjacent minor flap, to align the box, and with the inner confronting edges of the major flaps in flush, abutting relationship with one another.

When the major flaps are folded inwardly over the bottom of the box, as seen in FIG. 5, the free edges lie in flush, contiguous relationship with one another, defining a smooth interior bottom surface in the box.

Figure 7:
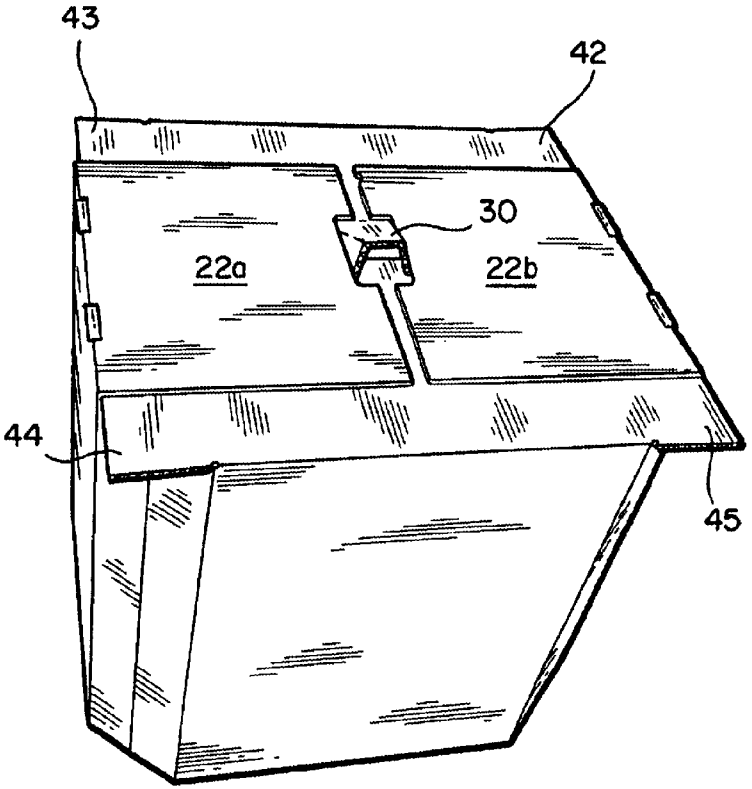
FIG. 7 is a bottom perspective view of the box of FIG. 6, depicting how the T-shaped locking tab is pulled outwardly through the opening formed by the cutouts in the confronting edges of the minor bottom flaps.
Figure 6:
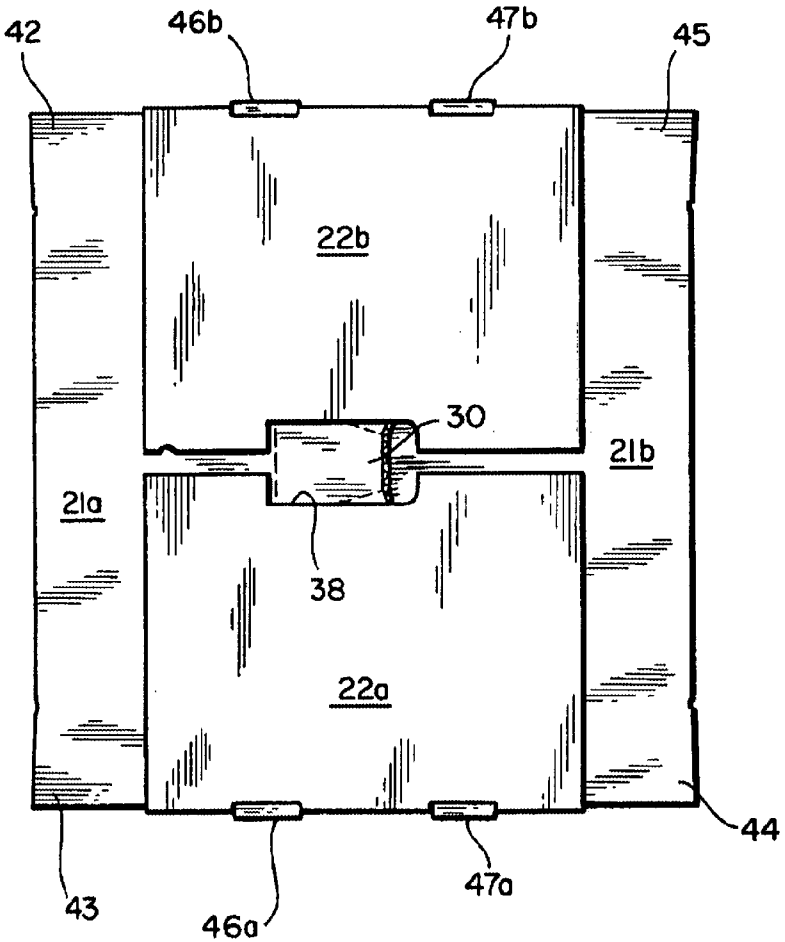
FIG. 6 is an outside bottom view similar to FIG. 5, but showing the minor flaps folded inwardly over the major flaps and over the T-shaped locking tab carried by one of the major flaps.
Figure 9:
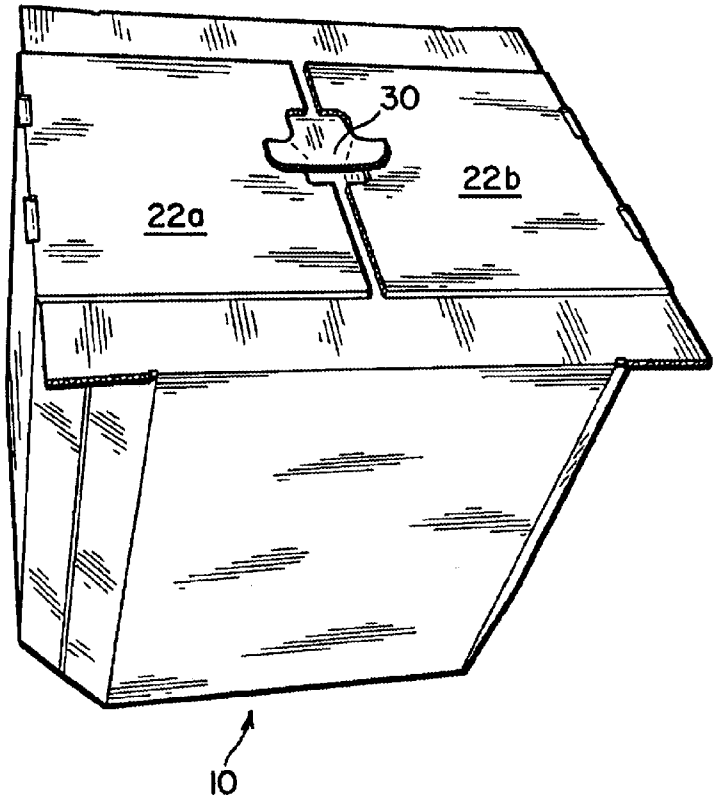
FIG. 9 is a bottom perspective view of the box of FIG. 8.
Figure 8:
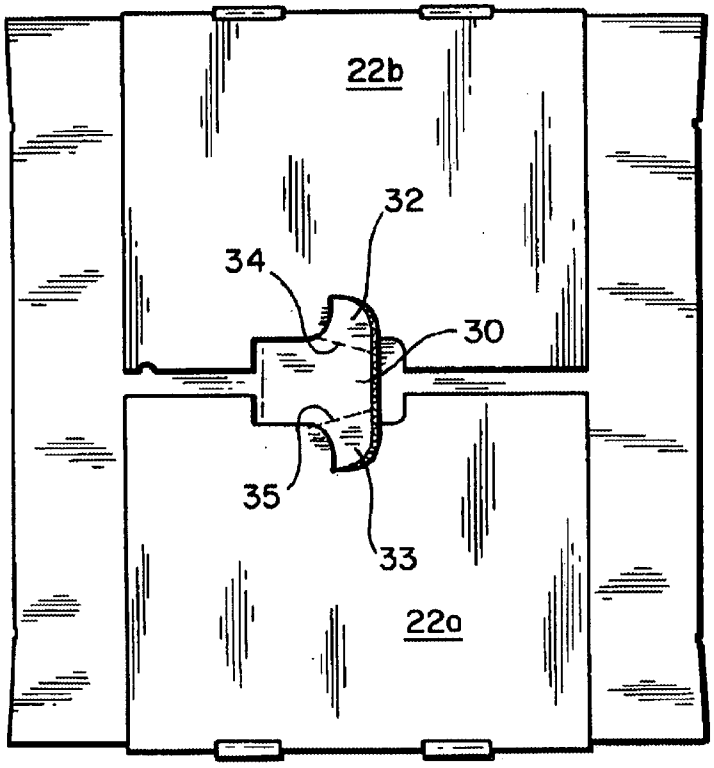
FIG. 8 is a bottom view similar to FIG. 6, but showing the locking tab in its operative, locked position engaged through the opening formed by the confronting edges of the minor flaps.
Figure 10:
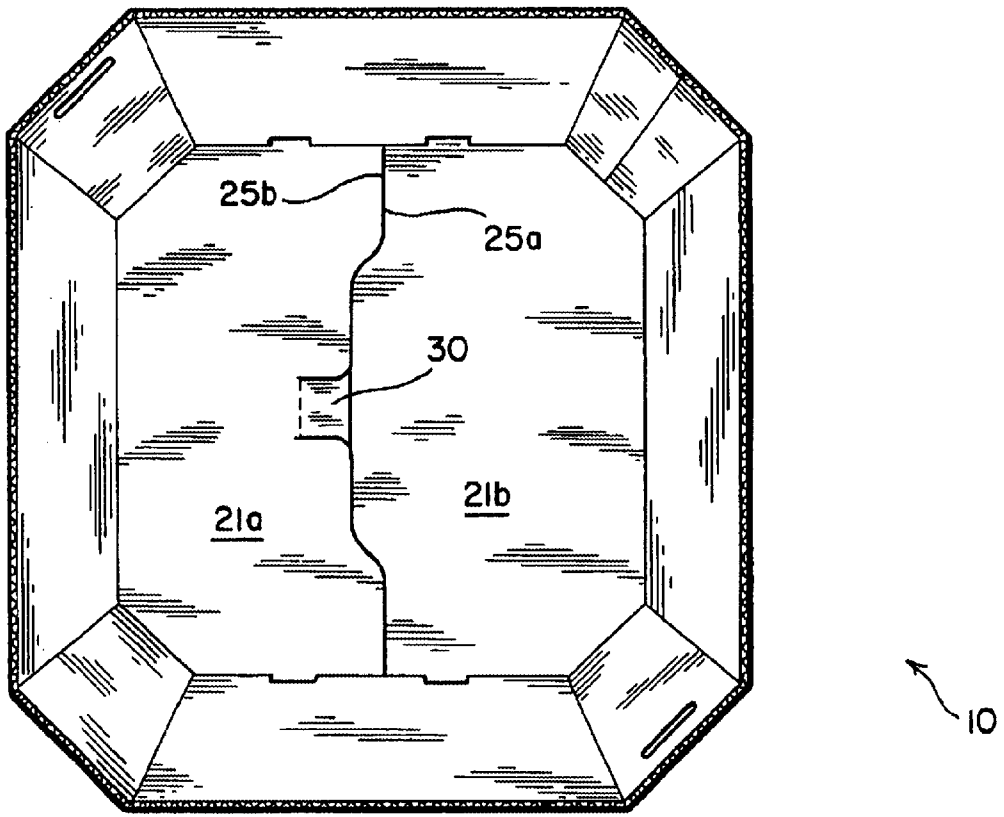
FIG. 10 is an inside bottom view of the erected box, showing the smooth interior bottom surface.

When the minor bottom flaps are folded inwardly toward one another over the bottom of the box, as shown in FIG. 6, the notches 27*a* and 27*b* in the free edges thereof lie in opposed relationship to one another, defining an opening 38 in registry with the T-shaped locking tab 30. Then, as shown in FIG. 7, the locking tab may be grasped and pulled through the opening, with the arms flexing and then springing outwardly over the adjacent edges of the minor flaps to lock the minor flaps, and thus the major flaps, in their inwardly folded positions over the bottom of the box. See FIGS. 8 and 9.

Additionally, the major flaps include side portions 40*a*, 40*b* and 41*a*, 41*b*, respectively, extending in alignment with and cut from the bottom ends of the associated diagonal corner panels, so that when the major flaps are folded inwardly over the bottom of the box, the corners of the side portions project beyond the diagonal corner panels to define fastening tabs 42, 43, 44 and 45 that may be used to secure the box to a pallet. In this regard, the box may be placed upon a suitable pallet, and the tabs stapled or otherwise secured to the pallet.

Further, to assist in aligning the box as it is being set up, small tabs 46*a*, 46*b* and 47*a*, 47*b*, project from the outer edges of the respective side portions, and in a preferred construction are positioned near the free edge of the respective flaps. Pairs of spaced slots 48*a*, 48*b* and 49*a*, 49*b* are formed along the respective scores for the minor bottom flaps, and when the major bottom flaps are folded inwardly, as shown in FIG. 5, the tabs 46*a*, 46*b* and 47*a*, 47*b* sweep along the surface of the minor bottom flaps until they come into registry with the slots, whereupon the tabs project through the slots. The tabs and slots are located so that when they are interengaged the box is properly squared up, and is held in this position.

When the major and minor flaps are folded inwardly over the bottom of the box into overlying relationship with one another, it is necessary only to pull outwardly on the locking tab, as depicted in FIG. 7, to cause the tab to flex and project through the opening 38. The arms 32, 33 flex during this action, and after passing through the opening spring outwardly to lock behind the minor flaps.

Figure 2:
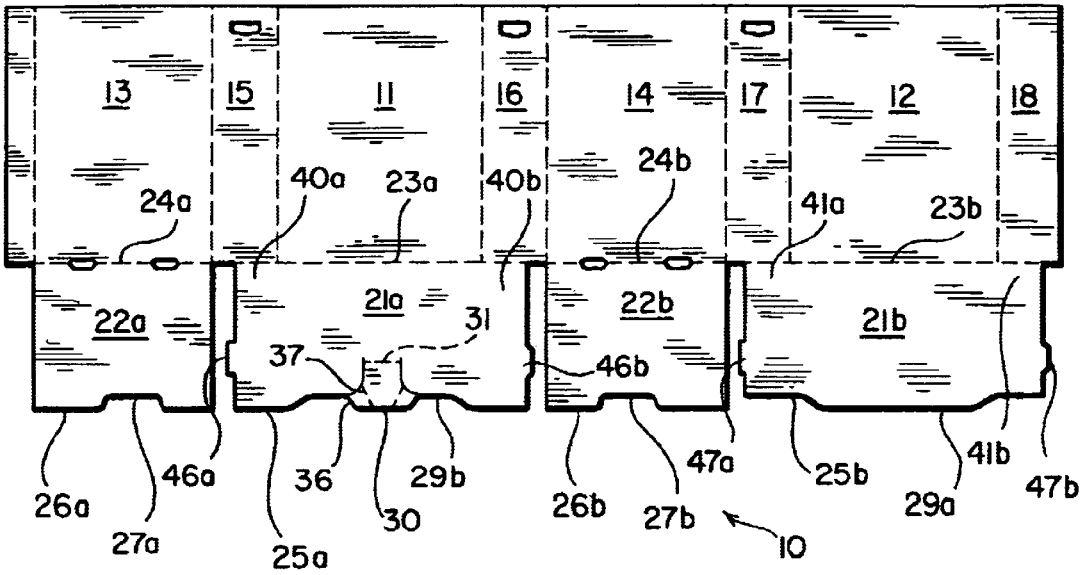
FIG. 2 is a top plan view of the blank used to make the box of the invention.
Figure 3:
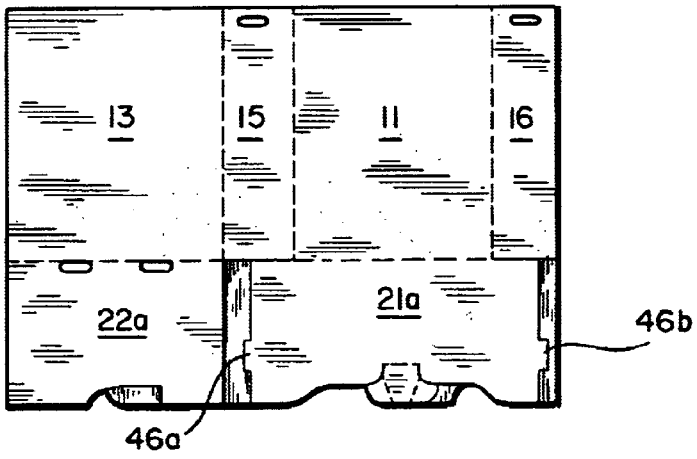
FIG. 3 is a top plan view of the box of the invention lying on its side in a folded flat condition.
Figure 4:
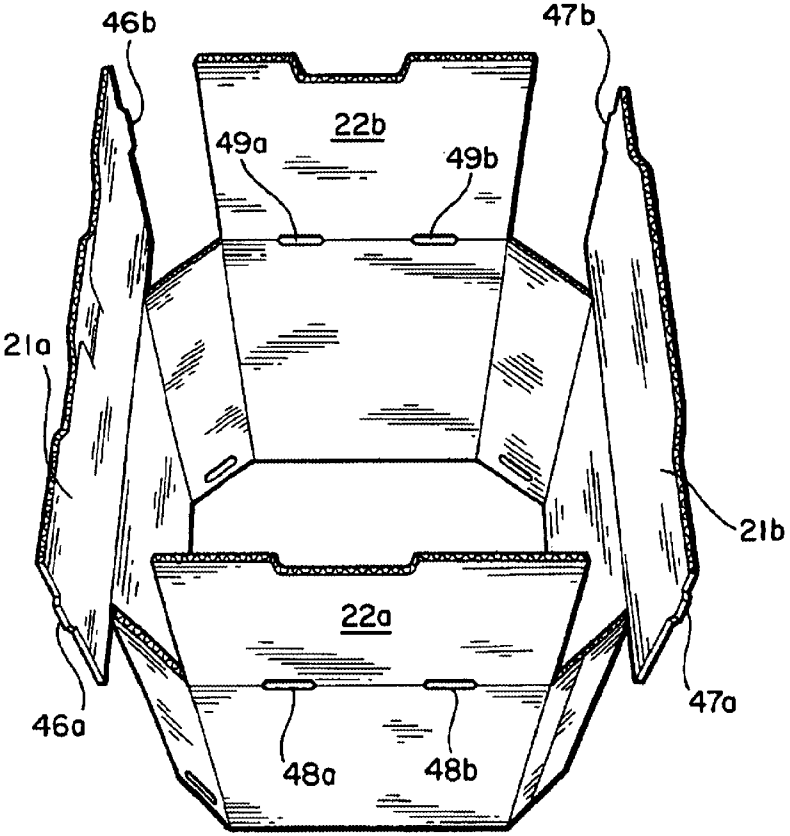
FIG. 4 is a bottom perspective view of a partially erected box according to the invention, shown with its bottom side nearest, and the major and minor bottom flaps in outwardly splayed positions, with the minor flaps oriented at the top and bottom in the figure and the major flaps oriented at opposite sides, respectively.

The box of the invention is made from a single blank 50 of material (see FIG. 2), and includes a glue flap 51 on one side edge thereof. During manufacture, the blank is folded upon itself and the glue flap is adhesively attached to a corner panel 18 at the opposite edge of the blank to form a flattened, open-ended tubular construction as shown in FIGS. 3 and 4. The box may be stored and shipped in this flattened condition to a point of use.

At the point of use, the flattened box is opened up or expanded into the open tubular configuration shown in FIG. 4. Although shown in the drawings resting on what would normally be its upper end, the box is easiest to set up while lying on its side, with the minor bottom flaps 22*a* and 22*b* oriented uppermost and lowermost, respectively.

At least some bulk boxes in accordance with the invention may have a liner laminated on the inside wall. The liner, and the box, may both comprise triple wall AA flute, suitably treated for moisture resistance. Alternatively, other flute constructions, suitable for a particular application, may be used in the construction of the box.

Further, many applications require the use of a flexible bag liner placed in the box. Many prior art boxes have structure projecting into the interior of the box, with the potential of chafing or puncturing the bag liner. The smooth interior surface of the box of the present invention eliminates this potential for damage to the liner.

Still further, in the particular embodiment illustrated and described herein, openings 60 are formed in some of the sidewalls for cooperating with a locking structure on a cap (not shown) to be placed on the open upper end of the box.

While particular embodiments of the invention have been illustrated and described in detail herein, it should be understood that various changes and modifications may be made to the invention without departing from the spirit and intent of the invention as defined by the scope of the appended claims.

What is claimed is:

1. A box, comprising:

opposed pairs of parallel side walls defining an enclosure;

opposed pairs of bottom flaps foldably connected along score lines at one edge to respective pairs of said opposed side walls, said bottom flaps having free edges opposite their connection with the respective side walls;

a first pair of said bottom flaps being first folded inwardly toward one another over the bottom of the box, with the free edges thereof lying in confronting substantially contiguous and abuttingly coplanar relationship with one another to define a substantially smooth inner bottom surface in the box;

a second pair of said bottom flaps being folded inwardly toward one another over the bottom of the box, with the free edges thereof lying in adjacent confronting relationship with one another, and the free edge of at least one flap of said second pair of opposed bottom flaps having a notch therein, said notch forming a central opening between the adjacent confronting edges of said second pair of flaps when they are folded inwardly over the bottom of the box; and a single T-shaped locking tab on the free edge of one of the flaps of the first pair of opposed bottom flaps, said locking tab joined to said one flap by a score line at one end and having outwardly extending arms at its other end, said locking tab being adapted to be flexed about the score line and inserted through said central opening to a position external of the box, with the locking tab projecting forwardly from the score line and lying against the adjacent edges of the second pair of opposed bottom flaps and with the outwardly extending arms lying over said adjacent edges of the second pair of opposed bottom flap to lock the flaps in their inwardly folded position over the box bottom.

2. A box as claimed in claim 1, wherein:

diagonal corner panels extend between the opposed pairs of side walls; and said first pair of bottom flaps comprise a pair of opposed major flaps having side portions extending in alignment with and cut from bottom ends of the associated diagonal corner panels, so that when the major flaps are folded inwardly over the bottom of the box, corners of the side portions project beyond the diagonal corner panels to define fastening tabs that may be used to secure the box to a pallet.

3. A box as claimed in claim 1, wherein:

aligning tabs are on opposite side edges of at least one of the flaps in said first opposed pair of flaps; and a slot is at the score line joining at least one of the flaps in said second opposed pair, said slot being positioned to receive the aligning tab at the side edge of said at least one flap in the first pair of flaps.

4. A box as claimed in claim 3, wherein:

an aligning tab is on each of the opposite side edges of each of the flaps in said first pair of flaps; and a pair of spaced slots are at the score line joining each of the flaps in said second pair of flaps to their respective side walls, one of the slots in each pair of slots being positioned to receive the tabs at opposite side edges of a respective one of the flaps in said first pair of flaps.

5. A box as claimed in claim 3, wherein:

the aligning tabs are on the outer edges of the side portions of the major bottom flaps; and the slots are at the scores joining the minor bottom flaps to their associated side panels.

6. A box as claimed in claim 5, wherein:

the box is made of corrugated paperboard.

7. A box, comprising:

opposed pairs of parallel side walls defining an enclosure;

opposed pairs of bottom flaps foldably connected along score lines at one edge to respective pairs of said opposed side walls, said bottom flaps having free edges opposite their connection with the respective side walls;

a first pair of said bottom flaps being first folded inwardly toward one another over the bottom of the box, with the free edges thereof lying in confronting substantially contiguous and abuttingly coplanar relationship with one another to define a substantially smooth inner bottom surface in the box;

an opening formed in at least one flap of a second pair of opposed bottom flaps, said opening being substantially centrally disposed in the bottom of the box when said second pair of flaps are folded inwardly over the bottom of the box; and a single T-shaped locking tab projecting forwardly from the free edge of one of the flaps of the first pair of opposed bottom flaps, said locking tab joined to said one flap by a score line at one end and having laterally outwardly projecting arms at its other end, said locking tab being adapted to be flexed about the score line and inserted through said opening to a position external of the box, with the locking tab lying at an acute angle relative to its unflexed position, projecting forwardly from the score line and the outwardly projecting arms engaged against said at least one flap to lock the flaps in their inwardly folded position over the box bottom.

8. A box as claimed in claim 7, wherein:

said opening is formed by opposed aligned notches in free edges of said second pair of bottom flaps.

* * * * *